US008992244B2

(12) United States Patent
Uchiyama et al.

(10) Patent No.: US 8,992,244 B2
(45) Date of Patent: Mar. 31, 2015

(54) TERMINAL FITTING

(71) Applicants: Autonetworks Technologies, Ltd., Yokkaichi, Mie (JP); Sumitomo Wiring Systems, Ltd., Yokkaichi, Mie (JP); Sumitomo Electric Industries, Ltd., Osaka-shi, Osaka (JP)

(72) Inventors: Yoshihiro Uchiyama, Mie (JP); Satoshi Morikawa, Mie (JP); Takuji Ootsuka, Mie (JP); Chikamasa Sasaki, Mie (JP); Hiroki Hirai, Mie (JP); Junichi Ono, Mie (JP)

(73) Assignees: Autonetworks Technologies, Ltd., Yokkaichi (JP); Sumitomo Wiring Systems, Ltd., Yokkaichi (JP); Sumitomo Electric Industries, Ltd., Osaka (JP)

( * ) Notice: Subject to any disclaimer, the term of this patent is extended or adjusted under 35 U.S.C. 154(b) by 115 days.

(21) Appl. No.: 13/760,294

(22) Filed: Feb. 6, 2013

(65) Prior Publication Data

US 2013/0210255 A1 Aug. 15, 2013

(30) Foreign Application Priority Data

Feb. 10, 2012 (JP) ..... 2012-026881

(51) Int. Cl.

| | |
|---|---|
| ***H01R 13/52*** | (2006.01) |
| ***H01R 4/18*** | (2006.01) |
| ***H01R 4/20*** | (2006.01) |
| ***H01R 4/72*** | (2006.01) |
| ***H01R 13/04*** | (2006.01) |
| ***H01R 13/11*** | (2006.01) |
| ***H01R 43/00*** | (2006.01) |
| ***H01R 43/16*** | (2006.01) |

(52) U.S. Cl.

CPC ..... *H01R 13/52* (2013.01); *H01R 4/184* (2013.01); *H01R 4/20* (2013.01); *H01R 4/72* (2013.01); *H01R 13/04* (2013.01); *H01R 13/113* (2013.01); *H01R 43/005* (2013.01); *H01R 43/16* (2013.01)

USPC ..... 439/271

(58) Field of Classification Search

USPC ..... 439/271, 882–883, 936, 874, 866; 174/72 R, 74 R

See application file for complete search history.

(56) References Cited

U.S. PATENT DOCUMENTS

| | | | | |
|---|---|---|---|---|
| 2008/0172874 | A1* | 7/2008 | Yagi et al. | 29/861 |
| 2012/0329341 | A1* | 12/2012 | Morikawa et al. | 439/866 |
| 2013/0008714 | A1* | 1/2013 | Morikawa et al. | 174/74 R |

FOREIGN PATENT DOCUMENTS

| | | |
|---|---|---|
| FR | 2884974 | 10/2006 |
| JP | 2000-285983 | 10/2000 |
| WO | 2012018049 | 2/2012 |

*Primary Examiner* — Jean F Duverne

(74) *Attorney, Agent, or Firm* — Gerald E. Hespos; Michael J. Porco; Matthew T. Hespos

(57) ABSTRACT

An object of the present invention is to provide a terminal fitting with improved waterproof property. A terminal fitting (10) includes a box-shaped main portion (21), barrel portions (22, 23) to be crimped and connected to a core (91) at an end portion of a wire (90), a waterproof wall (60) to be mounted between the barrel portions (22, 23) and the main portion (21) to partition between them in a liquid-tight manner, a restricting portion (25) configured to restrict a movement of the waterproof wall (60) toward the main portion (21) by coming into contact with the waterproof wall (60) from the main portion (21) side and a heat shrinkable tube (70) to be held in close contact with the barrel portions (22, 23) and the waterproof wall (60) while surrounding the core (91).

7 Claims, 9 Drawing Sheets

TERMINAL FITTING

BACKGROUND OF THE INVENTION

1. Field of the Invention

The present invention relates to a terminal fitting.

2. Description of the Related Art

A conventional terminal fitting is disclosed in Japanese Unexamined Patent Publication No. 2000-285983. This includes a main portion connectable to a mating terminal fitting, a wire barrel portion to be crimped and connected to a core at an end portion of a wire, an insulation barrel portion to be crimped and connected to an insulation coating at the end portion of the wire and a coupling portion located between the wire barrel portion and the main portion. Further, a heat shrinkable tube is mounted on a part from the insulation barrel portion to the coupling portion. A connecting part between the terminal fitting and the wire is made waterproof by this heat shrinkable tube.

In the case of the conventional terminal fitting, the leading end of the heat shrinkable tube is open. Thus, water may enter through the leading end of the heat shrinkable tube to come into contact with the core. In view of this, if a waterproof wall for partitioning between the wire barrel portion and the main portion in a liquid-tight manner is provided between them and the heat shrinkable tube is mounted in close contact with this waterproof wall, the contact of water with the core can be prevented. However, in this case, the waterproof wall may possibly be displaced in a direction away from the wire barrel portion. Then, there is a problem that the leading end of the heat shrinkable tube does not reach the waterproof wall and the contact of water with the core cannot be reliably avoided.

The present invention was completed based on the above situation and an object thereof is to provide a terminal fitting capable of maintaining high waterproof property.

SUMMARY OF THE INVENTION

In order to achieve the above object, a first aspect of the present invention is directed to a terminal fitting to be connected to an end portion of a wire, comprising a main portion connectable to a mating terminal fitting; a barrel portion to be crimped and connected to a core at the end portion of the wire; a waterproof wall to be mounted between the barrel portion and the main portion to partition between the barrel portion and the main portion in a liquid-tight manner; a restricting portion configured to restrict a movement of the waterproof wall toward the main portion by coming into contact with the waterproof wall from the main portion side; and a tube to be held in close contact with the barrel portion and the waterproof wall while surrounding the core.

According to a second aspect of the present invention, in the terminal fitting according to the first aspect, the restricting portion is formed by being bent from a coupling portion located between the main portion and the barrel portion.

According to a third aspect of the present invention, in the terminal fitting according to the first or second aspect, the restricting portion includes a first restricting portion which comes into contact with the waterproof wall from the main portion side and a second restricting portion which comes into contact with the waterproof wall from the barrel portion side.

According to a fourth aspect of the present invention, in the terminal fitting according to the third aspect, a space into which the waterproof wall is to be positioned and inserted is formed between the first and second restricting portions.

Since the tube is held in close contact with the barrel portion and the waterproof wall while surrounding the core, the contact of water with the core can be prevented and waterproof property can be ensured. Further, since the movement of the waterproof wall toward the main portion is restricted by the contact of the restricting portion with the waterproof wall from the main portion side, the tube can be reliably held in close contact with the waterproof wall and high waterproof property can be maintained.

Since the restricting portion is formed by being bent from the coupling portion located between the main portion and the barrel portion, formability is excellent without particularly complicating the structure of the restricting portion.

Since the restricting portion includes the second restricting portion that comes into contact with the waterproof wall from the barrel portion side in addition to the first restricting portion, a movement of the waterproof wall toward the barrel portion can also be restricted and reliability in movement restriction can be improved. Further, even if the waterproof wall is thinned to such an extent that it is difficult to stand alone, it can be supported by the first and second restricting portions. The waterproof wall can be thinned and the entire length of the terminal fitting can be correspondingly made shorter.

Since the space into which the waterproof wall is to be positioned and inserted is formed between the first and second restricting portions, a displacement of the waterproof wall can be prevented and the tube can be reliably held in close contact with the waterproof wall at a predetermined position.

DETAILED DESCRIPTION OF THE PREFERRED EMBODIMENTS

Figure 1:
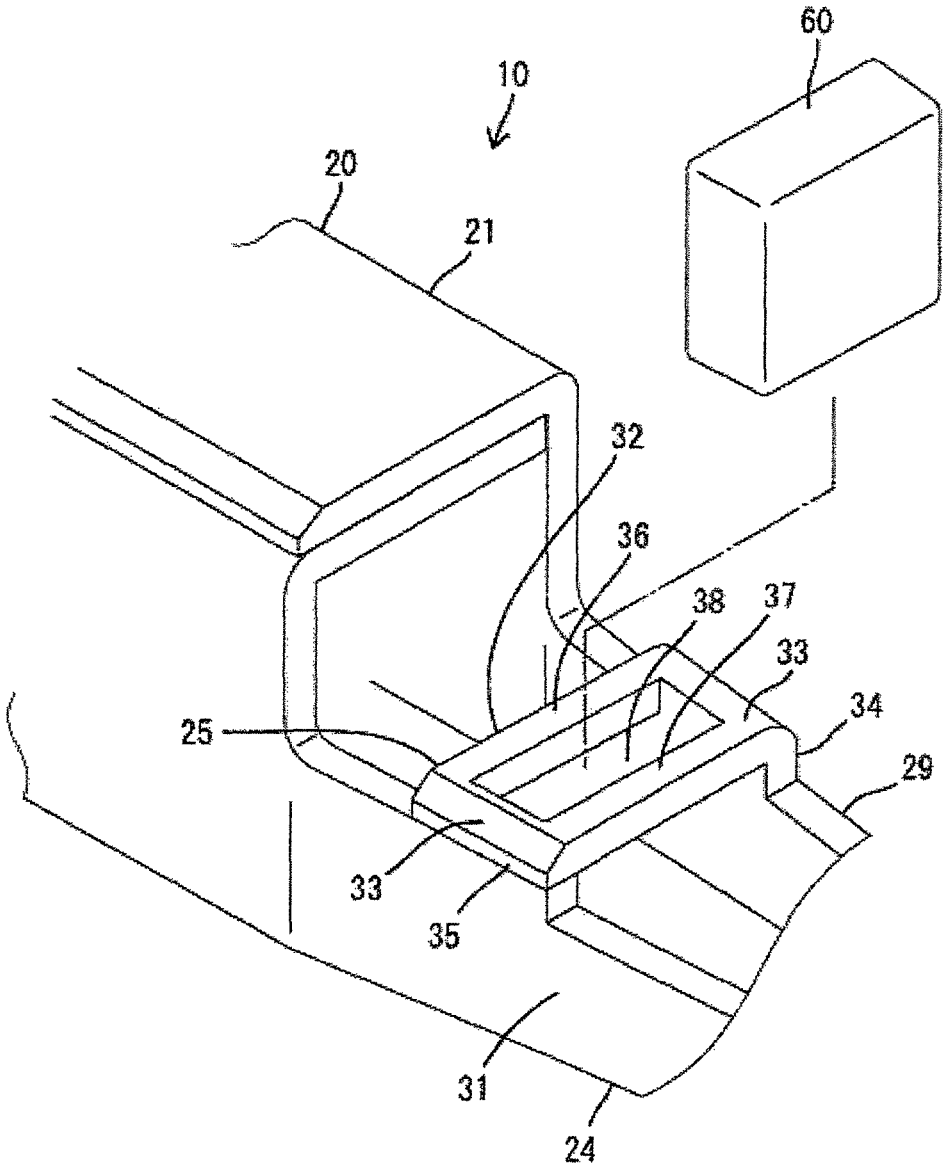
FIG. 1 is an enlarged perspective view of an essential part showing a state before a waterproof wall is mounted in a terminal fitting according to a first embodiment of the present invention.

A first embodiment of the present invention is described with reference to FIGS. 1 to 3. A terminal fitting 10 according to the first embodiment includes a terminal main body 20, a waterproof wall 60 and a heat shrinkable tube 70 and is connected to an end portion of a wire 90 as shown in FIG. 2.

The terminal main body 20 is integrally formed, such as by bending a metal plate made of copper or copper alloy and composed of a main portion 21, barrel portions 22, 23 located behind the main portion 21, a coupling portion 24 located between the barrel portions 22, 23 and the main portion 21 to couple them, and a restricting portion 25 formed integrally to the coupling portion 24.

The main portion 21 is formed into a substantially rectangular tubular shape with open front and rear surfaces by bending the metal plate in a width direction a plurality of times. A resilient contact piece 26 is formed in the main portion 21. The resilient contact piece 26 is in the form of a cantilever folded backward from the front end of a bottom wall 27 of the main portion 21 and resiliently deformable upward and downward with the front end of the bottom wall 27 as a supporting point. When the terminal fitting 10 is connected to an unillustrated mating terminal fitting, a tab of the mating terminal fitting is inserted into the main portion 21 from front and resiliently comes into contact with the resilient contact piece 26, whereby the two terminal fittings are electrically connected.

The barrel portions 22, 23 are composed of the wire barrel portion 22 and the insulation barrel portion 23 located behind the wire barrel portion 22. The wire barrel portion 22 and the insulation barrel portion 23 are both in the form of an open barrel and crimped and connected to the end portion of the wire 90.

The wire 90 is composed of a core made of aluminum or aluminum alloy and formed by twisting a plurality of strands, and an insulation coating 92 made of resin and surrounding the core 91. The insulation coating 92 is stripped at a front end portion of the wire 90 to expose the core 91.

The wire barrel portion 22 is crimped and connected to the core 91 from an outer side, and the insulation barrel portion 23 is crimped and connected to the insulation coating 92 from an outer side. A part of the front end portion of the core 91, to which the wire barrel portion 22 is crimped and connected, before the front end of the wire barrel portion 22 is bent up as shown in FIG. 2.

Figure 2:
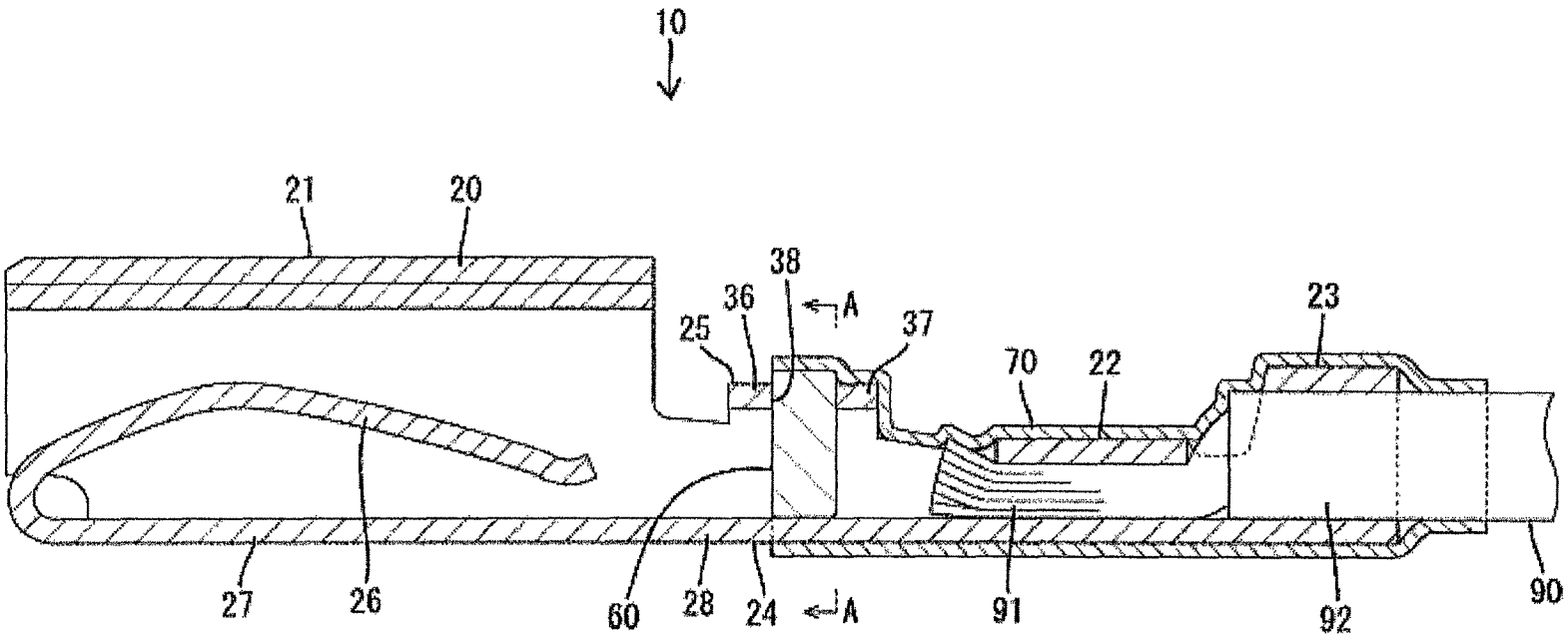
FIG. 2 is a side view in section.
Figure 3:
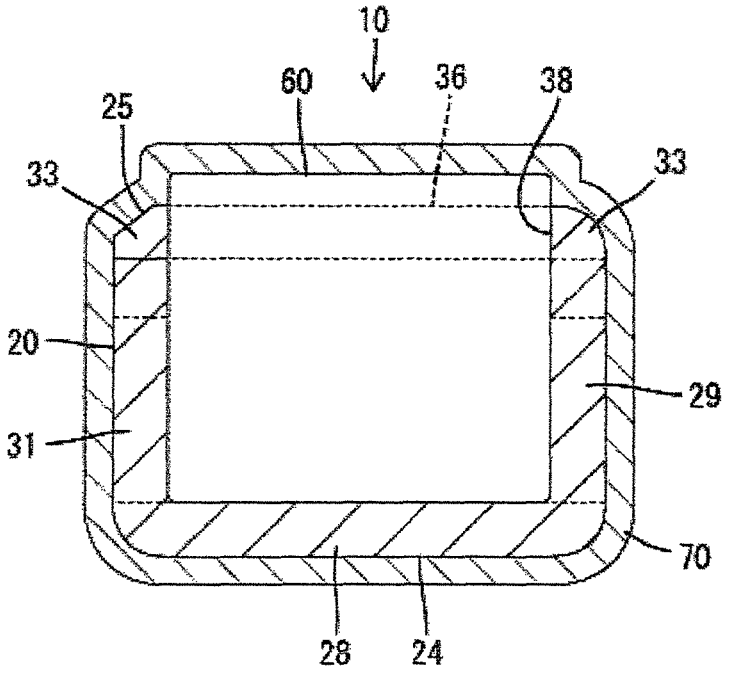
FIG. 3 is a section along A-A of FIG. 2.

As shown in FIG. 3, the coupling portion 24 has a substantially U-shaped cross-section and includes a bottom plate portion 28 and a pair of side plate portions 29, 31 standing up from opposite lateral edges of the bottom plate portion 28. The bottom plate portion 28 is connected to a bottom wall 27 of the main portion 21 without forming any step as shown in FIG. 2. Further, the bottom plate portion 28 is gradually narrowed from the main portion 21 toward the wire barrel portion 22.

As shown in FIG. 1, the restricting portion 25 includes a restricting main body 32 bridging between the upper end of one side plate portion (hereinafter, referred to as the first side plate portion 29) out of the both side plate portions 29, 31 and that of the other side plate portion (hereinafter, referred to as the second side plate portion 31). The restricting main body 32 is substantially horizontally arranged along the width direction and includes a base end portion 34 connected substantially at a right angle to the upper end of the first side plate portion 29 and a leading end portion 35 held in contact with the upper end of the second side plate portion 31 from above.

Further, the restricting main body 32 is in the form of a rectangular frame and includes a pair of short side portions 33 facing each other in the width direction and extending substantially parallel to forward and backward directions and a pair of long side portions 36, 37 facing each other in forward and backward directions and extending substantially parallel to the width direction. A rectangular space 38 is defined by the both long side portions 36, 37 and the both short side portions 33.

A waterproof wall 60 is inserted and fitted into the space 38 of the restricting main body 32 from above. In this case, as shown in FIG. 2, the front long side portion near the main portion 21 out of the both long side portions 36, 37 serves as a first restricting portion 36 for restricting a forward movement of the waterproof wall 60 and the rear long side portion near the wire barrel portion 22 serves as a second restricting portion 37 for restricting a backward movement of the waterproof wall 60. Further, as shown in FIG. 3, loose movements of the waterproof wall 60 in the width direction are restricted by the both short side portions 33.

The waterproof wall 60 is made of resin and substantially in the form of a rectangular block and has a width substantially equal to a distance between the inner surfaces of the both side plate portions 29, 31 and a height exceeding a distance from the inner surface of the bottom plate portion 28 to the space 38 of the restricting portion 25 as shown in FIG. 3. Further, the waterproof wall 60 is press-fitted into the space 38 of the restricting portion 25 and positioned and held in the space 38.

The heat shrinkable tube 70 is in the form of a tube long and narrow in forward and backward directions and mounted to cover from the insulation coating 92 at the end portion of the wire 90 to the waterproof wall 60 over the entire circumference as shown in FIG. 2. This heat shrinkable tube 70 is made of a synthetic resin material which shrinks upon being heated, and an unillustrated contact layer or adhesive layer is formed on the inner circumferential surface. Note that, in the case of this embodiment, the heat shrinkable tube 70 of a known type can be used.

Next, functions of the terminal fitting 10 according to the first embodiment are described.

As shown in FIG. 1, the waterproof wall 60 is press-fitted into the space 38 of the restricting portion 25 from above. Then, the bottom surface and the opposite side surfaces of the waterproof wall 60 respectively come into contact with the inner surfaces of the bottom plate portion 28 and the both side plate portions 29, 31 and the outer periphery of the upper end of the waterproof wall 60 is held in contact with the first and second restricting portions 36, 37 and the both short side portions 33 over the entire circumference. In this way, the waterproof wall 60 is positioned and held in the coupling portion 24. Further, the main portion 21 and the wire barrel portion 22 are partitioned in a liquid-tight manner by the waterproof wall 60 and the flow of water or the like can be blocked by the waterproof wall 60.

Subsequently, the heat shrinkable tube 70 in an unheated state is loosely fitted on the above terminal fitting 10 to surround the core 91 and areas before and after the core 91. Subsequently, the heat shrinkable tube 70 is heated and thermally shrunk. Then, a rear end portion of the heat shrinkable tube 70 is held in close contact with the insulation coating 92 at the end portion of the wire 90 over the entire circumference as shown in FIG. 2 and a front end portion of the heat shrinkable tube 70 is held in close contact with a part of the waterproof wall 60 projecting upward from the space 38, a substantially rear half of the restricting portion 25 and a substantially rear half of the coupling portion 24 as shown in FIG. 3. Further, the heat shrinkable tube 70 is also held in close contact with the insulation barrel portion 23, the wire barrel portion 22 and a part of the core 91 not covered by the wire barrel portion 22. In this way, the above respective parts are collectively surrounded by the heat shrinkable tube 70 and the heat shrinkable tube 70 is fixed while being held in close contact without forming any clearance in conformity with the outer shapes of the above respective parts.

As described above, according to the first embodiment, the contact of water with the core 91 can be prevented and predetermined waterproof property can be ensured since the heat shrinkable tube 70 is held in close contact with the wire barrel portion 22, the insulation barrel portion 23 and the waterproof wall 60 while surrounding the core 91. As a result, a situation can be prevented where electrolytic corrosion occurs using water as an intermediary because the terminal fitting 10 and the core 91 are made of dissimilar metals.

Further, because of the presence of the first restricting portion 36 for restricting a movement of the waterproof wall 60 toward the main portion 21 by the contact of the restricting portion 25 with the waterproof wall 60 from the main portion 21 side, the heat shrinkable tube 70 can be reliably held in close contact with the waterproof wall 60 and high waterproof property can be maintained.

Further, since the restricting portion 25 is formed by being bent from the coupling portion 24 located between the main portion 21 and the wire barrel portion 22, the structure thereof does not become particularly complicated.

Furthermore, since the restricting portion 25 includes the second restricting portion 37 that comes into contact with the waterproof wall 60 from the side of the wire barrel portion 22 and the insulation barrel portion 23 in addition to the first restricting portion 36, a movement of the waterproof wall 60 toward the wire barrel portion 22 and the insulation barrel portion 23 is also restricted and reliability in movement restriction can be improved. In this case, even if the waterproof wall 60 is thinned to such an extent that it is difficult to stand alone, it can be supported by the first and second restricting portions 36, 37. Thus, the waterproof wall 60 can be thinned and the entire length of the terminal fitting 10 can be correspondingly made shorter.

Further, since the space 38 into which the waterproof wall 60 is to be positioned and inserted is formed between the first and second restricting portions 36, 37, a displacement of the waterproof wall 60 can be prevented and the heat shrinkable tube 70 can be reliably held in close contact with the waterproof wall 60 at a predetermined position.

Figure 4:
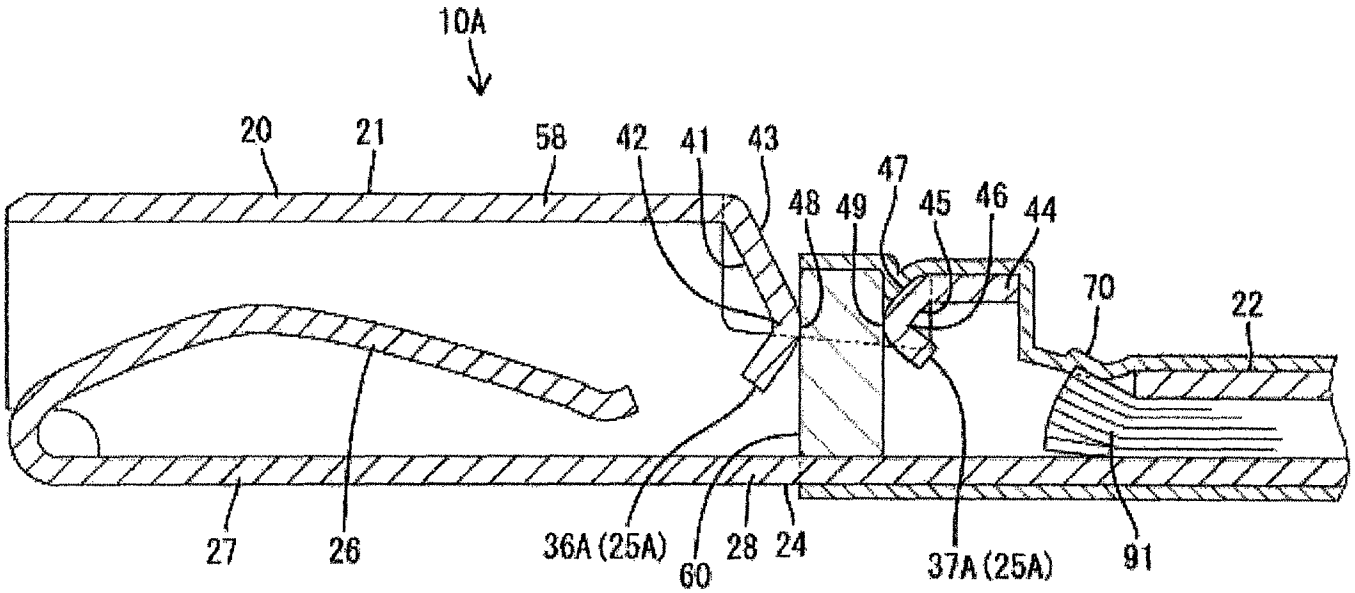
FIG. 4 is an enlarged section showing an essential part in a terminal fitting according to a second embodiment.
Figure 5:
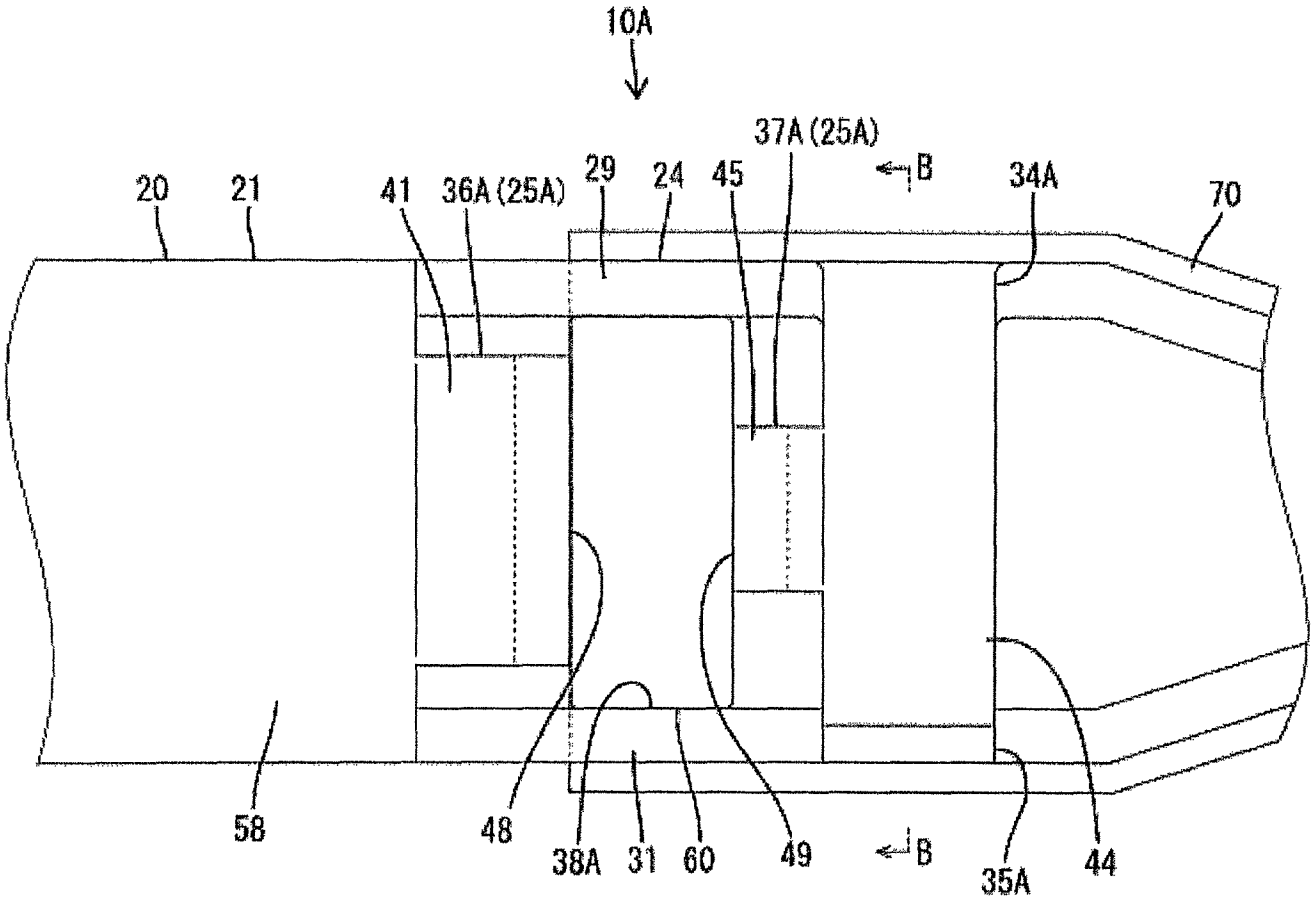
FIG. 5 is an enlarged plan view showing an essential part with a part of a heat shrinkable tube shown in section.
Figure 6:
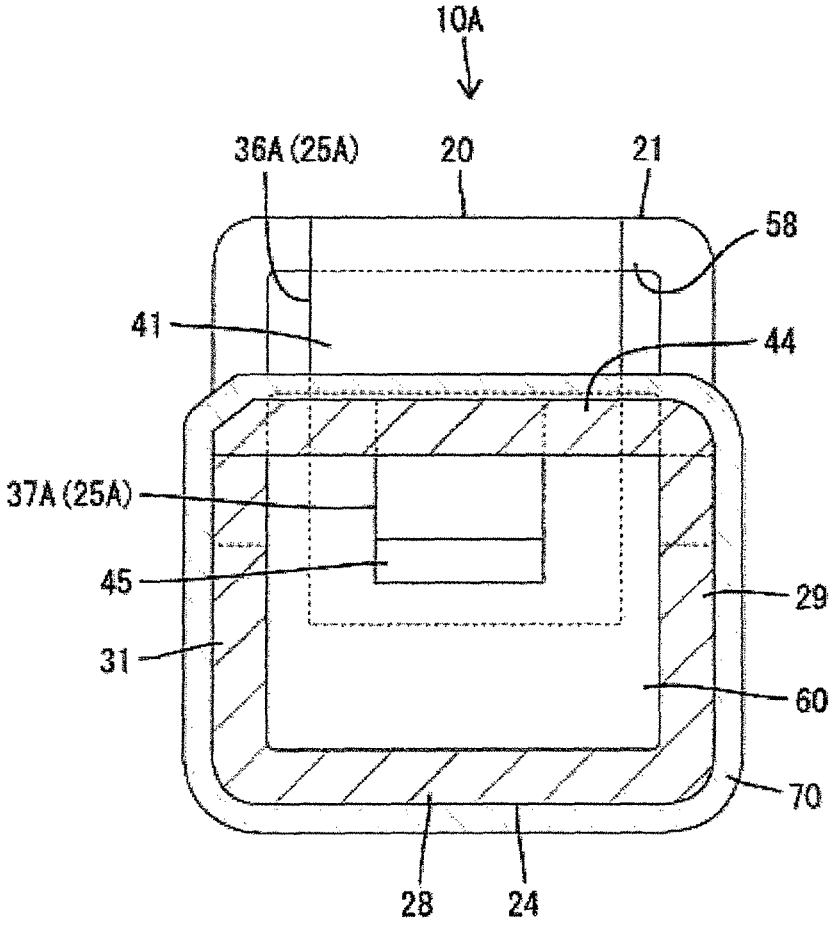
FIG. 6 is a section along B-B of FIG. 5.

FIGS. 4 to 6 show a second embodiment of the present invention. In a terminal fitting 10A according to the second embodiment, the structure of a restricting portion 25A differs from the first embodiment. The other configurations are similar to the first embodiment, and the configurations similar to the first embodiment are denoted by the same reference signs and not repeatedly described.

As shown in FIG. 4, the restricting portion 25A is composed of a first restricting portion 36A integrally coupled to the rear end of an upper wall 58 of a main portion 21 and a second restricting portion 37A integrally coupled to the upper end of a first side plate portion 29 of a coupling portion 24. The first restricting portion 36A is formed by a first resilient piece 41 extending obliquely downward to the back from a widthwise central part of the rear end of the upper wall 58. The first resilient piece 41 is resiliently deformable forward and backward with the rear end of the upper wall 58 as a supporting point. A first bent portion 42 bent substantially in L shape is formed at a lower end portion of the first resilient piece 41. The first bent portion 42 projects more backward than areas above and below it. Further, a part of the first resilient piece 41 above the first bent portion 42 serves as a first guiding portion 43 extending obliquely upward to the front.

As shown in FIG. 5, the second restricting portion 37A includes a bridging portion 44 extending from the upper end of the first side plate portion 29 to that of a second side plate portion 31. The bridging portion 44 is arranged substantially horizontally along the width direction and includes a base end portion 34A connected substantially at a right angle to the upper end of the first side plate portion 29 and a leading end portion 35A held in contact with the upper end of the second side plate portion 31 from above.

Further, the second restricting portion 37A includes a second resilient piece 45 extending obliquely downward to the front from a widthwise central part of the front end of the bridging portion 44. The second resilient piece 45 is resiliently deformable forward and backward with the front end of the bridging portion 44 as a supporting point. As shown in FIG. 4, a second bent portion 46 bent substantially in L shape is formed at a substantially central part in an extending direction of the second resilient piece 45. The second bent portion 46 projects more forward than areas above and below it. Further, a part of the second resilient piece 45 above the second bent portion 46 serves as a second guiding portion 43 extending obliquely upward to the back.

As shown in FIG. 4, tip portions 48, 49 of the first and second bent portions 42, 46 are located substantially at the same height position and arranged to face each other in forward and backward directions. As shown in FIG. 5, a space 38A into which a waterproof wall 60 is to be inserted is defined between the respective tip portions 48, 49 of the first and second bent portions 42, 46, and has a spacing smaller than the thickness of the waterproof wall 60 in forward and backward directions when the first and second resilient pieces 41, 45 are in a natural state.

Here, the waterproof wall 60 is inserted into the space 38A of the restricting portion 25A from above. In an insertion process, front and rear lower end portions of the waterproof wall 60 respectively slide on the first and second guiding portions 43, 47 to guide the waterproof wall 60 into the space 38A and, according to sliding movements thereof, the first and second resilient pieces 41, 45 are resiliently deformed in directions away from each other. When the bottom surface of the waterproof wall 60 comes into contact with a bottom plate portion 28 in this way, the tip portions 48, 49 of the first and second resilient pieces 41, 45 respectively resiliently come into contact with the both front and rear surfaces of the waterproof wall 60, whereby the waterproof wall 60 is positioned and resiliently held in the restricting portion 25A. Thereafter, a heat shrinkable tube 70 is mounted on the terminal fitting 10A and heated, thereby being held in close contact with and fixed to a part of the waterproof wall 60 projecting upward from the space 38A and a substantially rear half of the coupling portion 24, the second restricting portion 37A, a wire barrel portion 22, a part of a core 91 not covered by the wire barrel portion 22, an insulation barrel portion 23 and an insulation coating 92 at an end portion of the wire 90, respectively.

According to the second embodiment, the spacing of the space 38A of the restricting portion 25A needs not coincide with the thickness of the waterproof wall 60 in forward and backward directions and strict gap management is not necessary since the waterproof wall 60 is resiliently held in the restricting portion 25A.

Figure 7:
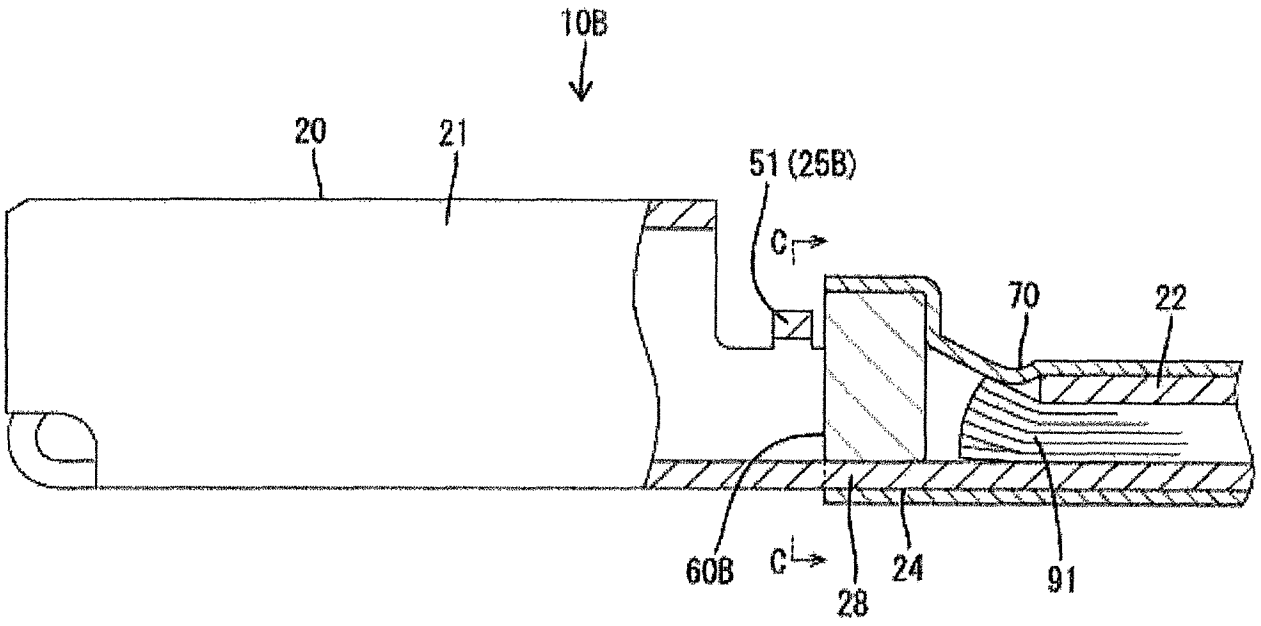
FIG. 7 is an enlarged section showing an essential part in a terminal fitting according to a third embodiment.
Figure 8:
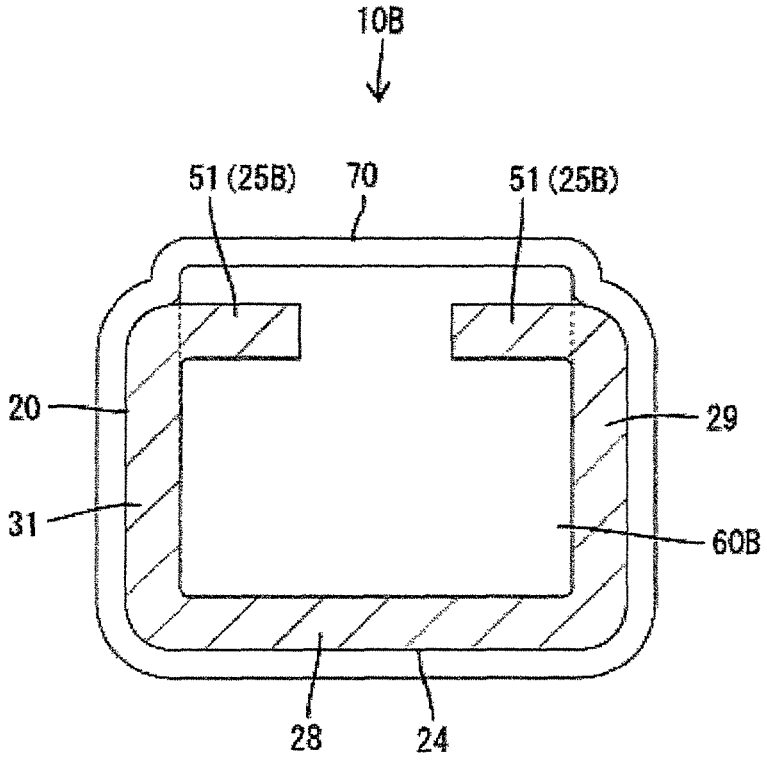
FIG. 8 is a section along C-C of FIG. 7.

FIGS. 7 and 8 show a third embodiment of the present invention. A terminal fitting 10B according to the third embodiment also differs from the first embodiment in the structure of a restricting portion 25B.

The restricting portion 25B is integrally coupled to both side plate portions 29, 31 of a coupling portion 24. Specifically, as shown in FIG. 8, the restricting portion 25B is composed of a pair of projecting pieces 51 bent inwardly substantially at a right angle from the upper ends of the both side plate portions 29, 31. The both projecting pieces 51 are in the form of rectangular plates and substantially horizontally arranged substantially at the same height position. The projecting ends of the both projecting pieces 51 are spaced apart by a distance shorter than the width of a waterproof wall 60B. Further, the rear ends of the both projecting pieces 51 and the front end of a core 91 are spaced apart by a distance longer than the thickness of the waterproof wall 60B in forward and backward directions.

The waterproof wall 60B has a larger thickness than the waterproof walls 60 of the first and second embodiments in forward and backward directions and can at least stand alone. The waterproof wall 60B is inserted behind the restricting portion 25B in the coupling portion 24. Then, the both projecting pieces 51 are arranged to face each other before the waterproof wall 60B. Thus, the front surface of the waterproof wall 60B comes into contact with the rear ends of the both projecting pieces 51, whereby any further forward movement of the waterproof wall 60B is prevented.

When being mounted on the terminal fitting 10B and heated, a heat shrinkable tube 70 is held in close contact with a connecting part of the terminal fitting 10B and a wire 90 and a front end portion of the heat shrinkable tube 70 is held in close contact with and fixed to an upper end portion of the waterproof wall 60B. Since the restricting portion 25B has a relatively simple structure according to the third embodiment, cost can be reduced due to easy production.

Figure 9:
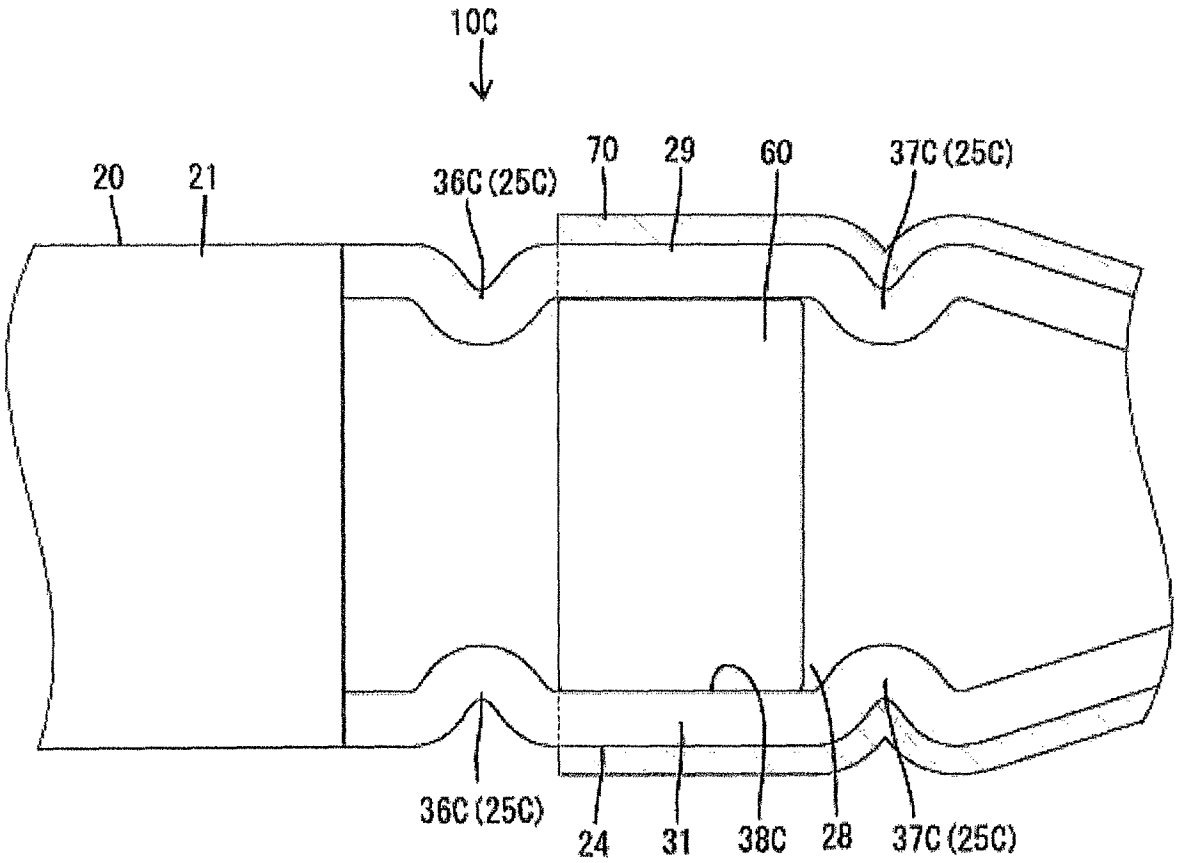
FIG. 9 is an enlarged plan view showing an essential part with a part of a heat shrinkable tube shown in section in a terminal fitting according to a fourth embodiment.

FIG. 9 shows a fourth embodiment of the present invention. A terminal fitting 10C according to the fourth embodiment also differs from the first embodiment in the structure of a restricting portion 25C.

The restricting portion 25C is integrally coupled to both side plate portions 29, 31 of a coupling portion 24. Specifically, the restricting portion 25C is composed of a pair of first restricting portions 36C formed by bending the both side plate portions 29, 31 inwardly at positions near a main portion 21 to have a substantially U-shaped cross-section and a pair of second restricting portions 37C likewise formed by bending the both side plate portions 29, 31 inwardly at positions behind the first restricting portions 36C to have a substantially U-shaped cross-section. The first and second restricting portions 36C, 37C are formed by hammering the both side plate portions 29, 31 from outer sides. Further, the first restricting portions 36C are located substantially at the same position in forward and backward directions and vertically extend. Similarly, the second restricting portions 37C are located substantially at the same position in forward and backward directions and vertically extend.

A space 38C is formed to be open upward between the first and second restricting portions 36C, 37C and a waterproof wall 60 is inserted into the space 38C from above. The front surface of the waterproof wall 60 is arranged to be able to come into contact with the both first restricting portions 36C and the rear surface of the waterproof wall 60 is arranged to be able to come into contact with the both second restricting portions 37C by fitting the waterproof wall 60 into the space 38C. Further, the bottom surface of the waterproof wall 60 is arranged to be able to come into contact with a bottom plate portion 28 and the opposite side surfaces of the waterproof wall 60 are arranged to be able to come into contact with the both side plate portions 29, 31. In this way, the waterproof wall 60 is positioned and held in the space 38C of the restricting portion 25C.

When being mounted on the terminal fitting 10C and heated, a heat shrinkable tube 70 is held in close contact with a connecting part of the terminal fitting 100 and a wire 90 and a front end portion of the heat shrinkable tube 70 is held in close contact with and fixed to an upper end portion of the waterproof wall 60. Since the waterproof wall 60 is positioned and held by the restricting portion 25C having a relatively simple structure according to the fourth embodiment, cost effectiveness is excellent.

The present invention is not limited to the above described and illustrated embodiments. For example, the following embodiments are also included in the technical scope of the present invention.

The core of the wire and the terminal fitting may be made of similar metals. For example, the core may be made of copper or copper alloy.

The terminal fitting may be a male terminal fitting with a main portion including a tab projecting forward. Further, the terminal fitting may be a round terminal (LA terminal) with a ring-shaped main portion.

The barrel portion may be composed only of the wire barrel portion without including the insulation barrel portion.

An elastic tube such as a rubber tube may be used in place of the heat shrinkable tube.

The waterproof wall has a rectangular shape in the above embodiments. However, if the terminal main body has a semicircular bottom shape, the waterproof wall may correspondingly have a circular shape.

What is claimed is:

1. A terminal fitting assembly, comprising:

a terminal main body formed from a metal material and including a main portion connectable to a mating terminal fitting, a barrel portion to be crimped and connected to a core at an end portion of a wire;

a restricting portion including an opening extending from an area outside the terminal main body to the space within the terminal main body between the main portion and the barrel portion;

a waterproof wall formed from resin and having an engaging portion engaged in the opening of the restricting portion so that the engaging portion restricts movement of the waterproof wall toward the main portion of the terminal main body, and a liquid blocking portion mounted in the space of the terminal main body between the barrel portion and the main portion to partition between the barrel portion and the main portion in a liquid-tight manner; and a tube to be held in close contact with the barrel portion and with a portion of the waterproof wall at the opening in the restricting portion while surrounding the core.

2. The terminal fitting assembly of claim 1, wherein the restricting portion is formed by being bent from a coupling portion located between the main portion and the barrel portion.

3. The terminal fitting assembly of claim 2, wherein the restricting portion includes a first restricting piece that comes into contact with the waterproof wall from the main portion side and a second restricting piece that comes into contact with the waterproof wall from the barrel portion side.

4. The terminal fitting assembly of claim 3, wherein the space into which the waterproof wall is to be positioned and inserted is formed between the first and second restricting pieces.

5. The terminal fitting assembly of claim 1, wherein the restricting portion includes a first restricting piece that comes into contact with the waterproof wall from the main portion side and a second restricting piece that comes into contact with the waterproof wall from the barrel portion side.

6. The terminal fitting assembly of claim 5, wherein a space into which the waterproof wall is to be positioned and inserted is formed between the first and second restricting pieces.

7. A terminal fitting assembly, comprising:

a terminal main body formed integrally from a metal material and including a main portion connectable to a mating terminal fitting, a barrel crimped and connected to a core at an end portion of a wire and a coupling extending integrally between the main portion and the barrel, the coupling having a bottom wall and defining a space above the bottom wall, a restricting portion bent from the coupling and partly covering the space, the restricting portion including an opening extending from an area outside the terminal main body to the space within the terminal main body between the main portion and the barrel portion;

a waterproof wall formed from resin and having an engaging portion engaged in the opening of the restricting portion so that the engaging portion restricts movement of the waterproof wall toward the main portion of the of the terminal main body, the waterproof wall having a bottom edge disposed on the bottom wall of the coupling and a liquid blocking portion in the space of the terminal main body between the barrel and the main portion to partition between the barrel and the main portion in a liquid-tight manner; and a tube held in close contact with the barrel and with a portion of the waterproof wall at the opening in the restricting portion while surrounding the core.

* * * * *